United States Patent [19]

Corbic

[11] 4,287,702

[45] * Sep. 8, 1981

[54] METHOD AND INSTALLATION FOR PACKAGING IN A STERILE MEDIUM

[75] Inventor: Yves J. Corbic, Chatou, France

[73] Assignee: Gatrun Anstalt, Vaduz, Liechtenstein

[ * ] Notice: The portion of the term of this patent subsequent to Aug. 28, 1996, has been disclaimed.

[21] Appl. No.: 900,870

[22] Filed: Apr. 28, 1978

Related U.S. Application Data

[63] Continuation-in-part of Ser. No. 750,959, Dec. 15, 1976, Pat. No. 4,155,786.

[30] Foreign Application Priority Data

May 10, 1977 [FR] France ..... 77 14285

[51] Int. Cl.[3] ..... B65B 43/08; B65B 47/04; B65B 55/10

[52] U.S. Cl. ..... 53/425; 53/426; 53/453; 53/484; 53/282; 53/559

[58] Field of Search ..... 53/426, 425, 453, 456, 53/468, 484, 485, 282, 167, 559, 561

[56] References Cited

U.S. PATENT DOCUMENTS

| | | | |
|---|---|---|---|
| 3,189,505 | 6/1965 | Sloan et al. | 53/559 X |
| 3,269,277 | 8/1966 | Dueringer et al. | 53/559 X |
| 3,564,812 | 2/1971 | Mueller et al. | 53/426 |
| 3,653,175 | 4/1972 | Rogiers | 53/559 |
| 3,899,862 | 8/1975 | Muys et al. | 53/426 |
| 3,911,640 | 10/1975 | Rausing | 53/426 |
| 3,942,299 | 3/1976 | Bory | 53/453 X |
| 3,946,929 | 3/1976 | Armetti | 53/559 X |
| 3,972,153 | 8/1976 | Kiellarson et al. | 53/485 X |
| 3,977,153 | 8/1976 | Schrenk | 53/453 |
| 4,165,594 | 8/1979 | Corbic | 53/425 X |

*Primary Examiner*—Horace M. Culver
*Attorney, Agent, or Firm*—Weingarten, Maxham & Schurgin

[57] ABSTRACT

A method of and an installation for packaging in a sterile medium employs a composite film constituted in a thermoplastic film in which containers are formed, and a covering film with their opposing faces sterile. These are separated at the entrance to a sterile enclosure in which the containers are formed and filled, in a sterile atmosphere, the thermoplastic film forming the lower wall of the enclosure. The full containers are covered with a strip from which lids are formed without the inside of the containers being able to be contaminated, and the covering strip and thermoplastic film are connected in an air-tight manner. The method and installation are particularly suitable for packaging perishable food products, in particular dairy products.

45 Claims, 6 Drawing Figures

II
II 42
41
42
40
52
50
51
20
25
16
30
12
28
10
26
25
24
22

42
41
42
40
V
V
25
54
55
57
16
30
12
36
40
25
20
50
53
51
23
24
22
26
10
27

METHOD AND INSTALLATION FOR PACKAGING IN A STERILE MEDIUM

CROSS REFERENCE TO RELATED APPLICATION

This is a continuation-in-part of United States patent application Ser. No. 750,959, filed Dec. 15, 1976, now U.S. Pat. No. 4,155,786 issued May 22, 1979.

The present invention relates to a method for packaging in a sterile medium, a method of the type in which containers are formed in a thermoplastic film, by forming the thermoplastic material in a heated state in a forming station. These containers are filled in a filling station, inside a sterile enclosure in which slight excess pressure prevails and which comprises side walls and an upper wall and lower wall at least partly constituted by this film. The full containers are then sealed, without it being possible for their contents to be contaminated by a non-sterile atmosphere, with a sheet, a so-called lids sheet whereof at least the side facing the inside of the containers is sterile.

A principle difficulty in known methods of the above-mentioned type is to supply a thermoplastic film which is both sterile and at the forming temperature to the inlet of the forming station. In fact, it is frequently stated that sterilization of the thermoplastic film is produced by the heat supplied to this film to bring the latter to the forming temperature. For satisfactory sterilization, it is necessary to heat the film to a certain temperature for a certain period of time, the minimum sterilization time being shorter, the higher the sterilization temperature required. Now the conditions for good sterilization can be met by heating the film simply to the forming temperature only if the time during which the film is kept at this temperature is relatively long. For a machine of the known type for packing dairy products in thermoformed containers, if one wishes to maintain an adequate production rate in the area of economical feasibility, then it is necessary for the thermoplastic film to travel over a distance of several meters in a heating tunnel. This would result in excessive bulk, an obvious danger of overheating of the film even in the case of a momentary stoppage thereof, and a long starting-up period with the certainty of an appreciable wastage of material.

Thus, in order to maintain reasonable dimensions and production rates, it may be attempted to sterilize the film before heating the latter to the forming temperature. This may be achieved by passing the film through a bath of sterilizing liquid. However, this makes the installation more complicated and is not readily acceptable when it is a question of packing food products.

The present invention intends to provide a method for packaging in a sterile medium, which has none of the aforesaid drawbacks, i.e. a method by virtue of which it is possible to supply to the inlet of the forming station, a thermoplastic film which is sterile and at the forming temperature, without the time or the heating device exceeding those necessary simply for heating the material to the forming temperature, without any danger of excessive softening of the film and without using a sterilizing product.

This object is achieved by a method in which, according to the invention, one uses a composite film constituted by the thermoplastic film covered, on its side subsequently intended to form the inner side of the containers, by at least one covering film, this composite film is moved towards the inlet of the sterile enclosure, the thermoplastic film and the covering film being superimposed in an air-tight manner at least along their edges and with their opposing faces sterile. The covering film is separated from the thermoplastic film at the inlet of the sterile enclosure and, on leaving the sterile enclosure, the lids sheet is connected in an air-tight manner at least to the edges of the thermoplastic film comprising the full containers.

The thermoplastic film is heated to the forming temperature, after separation of the covering film, on its path between the inlet of the sterile enclosure and the forming station, a path in which the thermoplastic film possibly already constitutes a part of the lower wall of the enclosure. This heating is produced for example by passing the film over a hot surface, in particular one or more heated rollers.

The lids sheet is constituted by a moving covering strip which may be sterilized immediately before being supplied to the full containers, which is possible by the action of heat, in particular when this covering strip is made of metal, for example aluminium.

Whether or not it is made of metal, the covering strip could advantageously be withdrawn from a composite film, like the thermoplastic film. According to another feature of the method according to the invention, one uses a composite film constituted by the thermoplastic film and at least the covering strip, the latter constituting one or the covering film of this composite film. After separation from the thermoplastic film, the covering film is moved towards the outlet of the sterile enclosure along a path which overhangs that of the thermoplastic film and the forming and filling stations and, at the outlet of the sterile enclosure, the containers formed and filled are covered by the lower sterile side of the covering strip by applying this strip and the film comprising the containers one against the other in a sealed manner at least along their edges.

When the covering strip is withdrawn from a composite film, whether or not separate from that from which the thermoplastic film is withdrawn, it may be advantageous to use the covering strip to form at least one part of the upper wall of the sterile enclosure until the full containers are covered.

The invention also intends to provide an installation for carrying out the method described above, an installation of the type comprising a sterile enclosure having side walls, an upper and lower wall, means for supplying the enclosure with sterile gas at a pressure slightly higher than the pressure prevailing outside the enclosure, first means for conveying a film of thermoplastic material, this film forming at least a part of the lower wall of the sterile enclosure, a station for heating the thermoplastic film, a station for forming containers in this strip located at least partly in the sterile enclosure and comprising at least one mould able to move vertically below the thermoplastic film and at least one forming punch able to move vertically inside a forming chamber located above the thermoplastic film, a filling station comprising at least one nozzle supported by a nozzle support and opening out above the plane of the thermoplastic film, a covering station for covering the full containers with a covering strip and a sealing station for sealing the covering strip in an air-tight manner on each container around its filling aperture.

This object is achieved by an installation which comprises means for separating from the thermoplastic film, by a pulling action, at the inlet of the sterile enclosure, a covering film superimposed to the thermoplastic film in an air-tight manner at least along its edges, and in which the forming chamber and the nozzle support are mounted in an air-tight manner on part of the wall of the enclosure which overhangs the plane of the thermoplastic film, the members of the forming station located above the forming chamber, the members of the filling station located above the nozzle support and all the members of the covering and sealing stations being outside the sterile enclosure.

Advantageously, the heating means are located along at least one part of the path of the thermoplastic film between the entrance of the sterile enclosure and the forming station.

According to a particular embodiment of the installation according to the invention, the latter comprises guiding means for guiding the covering strip along a path separate from that of the thermoplastic film between a first location located upstream of the forming station and a second location forming the downstream end of the sterile enclosure and passing above the forming and filling stations.

Further features and advantages of the method and installation according to the invention will become apparent on reading the description given hereafter, by way of example, but in a non-limiting manner, with reference to the accompanying drawings in which:

FIG. 9 is a sectional view to an enlarged scale on line IX—IX of FIG. 7.

Figures 1, 2:
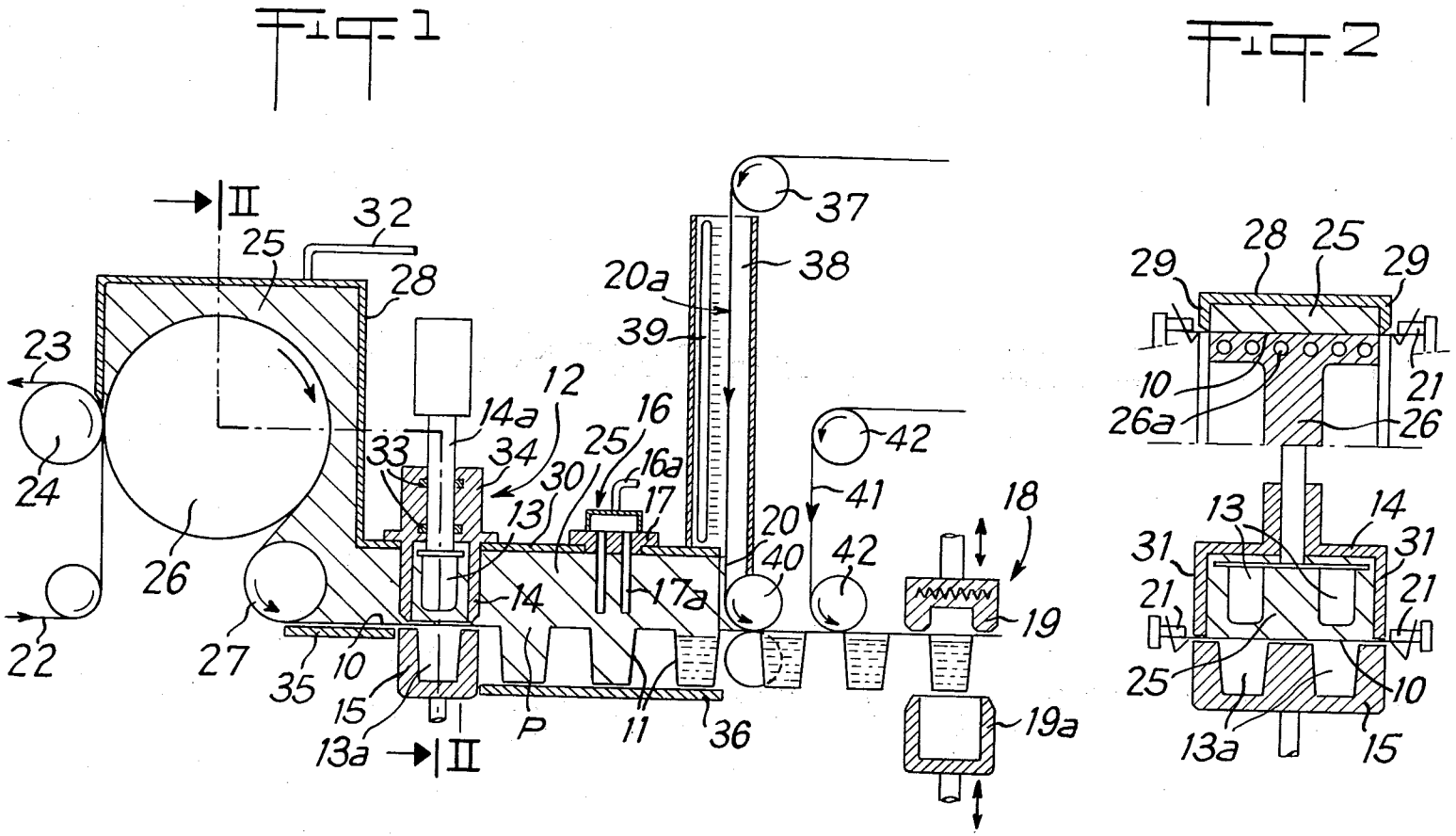
FIG. 1 is a very diagrammatic view in elevation and longitudinal section of an installation according to a first embodiment of the invention.
FIG. 2 is a diagrammatic view in section on line II—II of FIG. 1.

FIGS. 1 and 2 show an installation which comprises a forming station 12, a filling station 16 and a closing station 18 for respectively forming containers 11 in a film of thermoplastic material 10, filling the containers formed in the film and sealing the full containers still contained in the film 10, by means of a covering strip or sheet for lids 20.

The film 10 is moved stepwise, in a horizontal plane P, at least from the entrance of the forming station. The film is conveyed by gripping its edges by means of grippers 21 (FIG. 2) supported by endless parallel chain links passing over driving and return wheels (not shown). Conveying means of this type are known per se (see in particular U.S. Pat. No. 3,653,175).

The forming station 12 comprises at least one and, generally, several forming punches 13 able to move vertically inside a chamber 14 which is located above the plane in which the film 10 is conveyed in the station 12, the lower edge of the chamber 14 being flush with the surface of the film 10. Below the film 10, a mould 15 comprising several compartments 13*a*, the number of which corresponds to the number of punches 13 and the shape of which corresponds to that of the containers 11, is able to move vertically between an upper moulding position (FIGS. 1 and 2) in which the upper edge of the mould 15 presses the film 10 against the lower edge of the wall of the chamber 14 and a lower position in which the mould 15 clears a passage for the removal of the containers formed from the forming station.

The filling station 16, supplied with the product to be packed through a pipe 16*a*, comprises a nozzle support 17 which has one or more nozzles 17*a*, the number of which is equal to that of the containers to be filled simultaneously.

The full containers are sealed at the station 18 (shown solely in FIG. 1) by sealing the covering strip 20 around the filling aperture of the containers, which sealing is effected by means of a heating electrode 19 and counter-electrode 19*a* able to move vertically on either side of the plane in which the film 10 is conveyed.

According to the invention, the film 10 is withdrawn from a composite film 22 unwound from a storage roller for example (not shown). This composite film 22 is constituted by two superimposed films, the film 10 and a covering film 23, which are superimposed one on the other in an air-tight manner at least along their edges and the sides of which in facing relationship are sterile. These two films can be separated from each other under the action of slight pulling forces, which separation may possibly be facilitated by heating the composite film to a temperature, referred to as the separation temperature, slightly higher than ambient temperature, but appreciably less than the forming temperature to which the film 10 is heated before it enters the forming station 12.

The film 10 consists of thermoplastic material and the covering film 23 may be made from cellulosic material, such as paper or card, or of metal, such as aluminium or a metal alloy, or even of plastics material.

The composite film 22 may be produced in a sterile medium by heating the material constituting the films 10 and 23 to and maintaining them at a sterilization temperature for a period of time sufficient for their sterilization, then by connecting them, still in a sterile medium, by heat-sealing or sealing and in an air-tight manner at least in their marginal areas.

The composite film 22 may also be produced by extruding the thermoplastic material of the thermoplastic film 10 on the covering film 23 heated to the sterilization temperature, or by co-extruding the individual films forming the composite film, sterilization of the opposing faces of these individual films resulting from their manufacture without requiring subsequent treatment.

As shown in FIG. 1, the covering film 23 is separated from the thermoplastic film 10 and passed over a guide roller 24 where it is directed towards a re-winding cylinder (not shown) for possible re-use, this separation being effected at a location which constitutes the inlet of a sterile enclosure 25 (the inner space of which is represented by broken lines in FIGS. 1 and 2).

After entering the enclosure 25, the film 10 passes in succession over a heated drum 26 and a heated return roller 27 which guides the film towards the plane P along which this film is conveyed through the remainder of the installation. The drum 26, like the roller 27, is provided with incorporated heating means, for example inner passages 26*a* (FIG. 1) for a hot fluid in order to heat the film 10 to the forming temperature. The outer faces of the drum and roller are permanently hot and consequently sterile.

Between the entrance to the enclosure 25 and the line where it comes into contact with the roller 27, then from the line where it leaves the roller 27, the film 10 constitutes the lower wall of the sterile enclosure 25.

Upstream of the forming station, the enclosure is defined in its upper part by a rigid wall 28 which extends, above the film 10, from the entrance to the enclosure as far as the chamber 14. Laterally, the enclosure is closed-off by rigid vertical side walls 29 which are connected to the wall 28 and the lower edge of which has a profile whose shape corresponds exactly to that of the path of the film 10. As it travels, upstream of the forming station, this film 10 is gripped by its edges outside the side walls 29 and conveyed by the grippers 21, the paths of the endless chains whose links support these grippers being provided such that the film 10 slides on the lower edges of the side walls 29 (see FIG. 2).

Downstream of the entrance to the forming station, the enclosure is defined in its upper part by a rigid horizontal wall 30 which supports the chamber 14 and the nozzle support 17 and overhangs the plane in which the film 10 is conveyed. Vertical walls 31 close-off the enclosure laterally from the upper wall 30 as far as the level of the film 10, the latter also being gripped, as it travels horizontally, by the grippers 21 outside the side walls.

The enclosure 25 is supplied with sterile air through a pipe 32 connected to orifices (not shown) which open out inside the enclosure, such that a sterile atmosphere prevails in the latter at a pressure slightly higher than the external pressure. The purpose of this slight excess pressure is solely to prevent the external air from penetrating the enclosure by passing between the film 10 and the rigid side walls 29, 31 and it may be regulated by providing an outlet (not shown) controlled by a valve.

Gaskets 33 housed in a sleeve 34 which, in the forming station, surrounds the movable rod 14*a* which supports the punches 13 ensures the seal between the top of the chamber 14 and the outside.

Rigid walls 35, 36 outside the enclosure, extend horizontally below the path of the film 10 respectively upstream and downstream of the forming station, the wall 36 being able to move vertically.

As is apparent from FIG. 1, the parts of the forming station 12 which are located above the chamber 14, the parts of the filling station which are located above the nozzle support 17 and all the parts of the closing station 18 are outside the sterile enclosure 25.

The covering strip 20, withdrawn from a storage roller (not shown) and guided by a roller 37, passes through a vertical sterilization tunnel 38 in which at least the side 20*a* of this strip intended to be directed towards the inside of the containers is subjected to sterilization treatment by the heat liberated by a source 39.

The strip 20 penetrates the sterile enclosure 25, of which it constitutes a part of the end wall with its sterile side 20*a* facing the inside of the enclosure. Pairs of pressing rollers 40 press the edges of the film 10 and strip 20 one against the other and in an air-tight manner downstream of the filling station, the line of contact between the film and the strip constituting the downstream end of the sterile enclosure.

A covering band 41 withdrawn from a storage roller (not shown) and guided by rollers 42 is possibly pressed on the covering strip, behind the pressing rollers 40, this covering band being welded to the edges of the filling apertures in the containers, above the covering strip, at the station 18.

The operation of the installation shown in FIG. 1 will be understood from the preceding description. The films 22, 10 and strip 20 are moved stepwise in synchronism. This movement may be produced by various conveying means or by the same pair of chains comprising grippers 21. It is sufficient to provide devices for temporarily opening the grippers at the time of separation of the covering film 23 and at the time of the application of the covering strip 20 and the covering band 41. In this respect, as a variation, it will be noted that pressing of the edges of the film 10 and strip 20 one against the other in an air-tight manner could be achieved by the grippers 21 themselves. A solution of this type may in fact be perfectly satisfactory owing to the absence of a risk of contamination of the inside of the containers along the path which may be very short between the outlet of the sterile enclosure and the station 18.

At the time of starting-up, the inner sides of the rigid walls of the enclosure 25, the upper side of the wall 36 mounted in an upper position at the level of the lower edges of the walls 31 and the inside of the tunnel 38 are sterilized. The section of the front end of the film 10 is pulled as far as the outlet of the enclosure 25 and is covered by the end of the strip 20 and the sterile atmosphere is established inside the enclosure. The stepwise advance of the thermoplastic film in synchronism with the covering strip is then started only at the same time as the operation of the forming and filling stations, after the downwards movement of the movable wall 36 to clear a passage for the formed containers.

FIGS. 3 to 9 illustrate other embodiments of an installation for carrying out the invention. Parts common to the devices shown in the figures have the same references and their constructions and operations are described only once.

Figure 3:
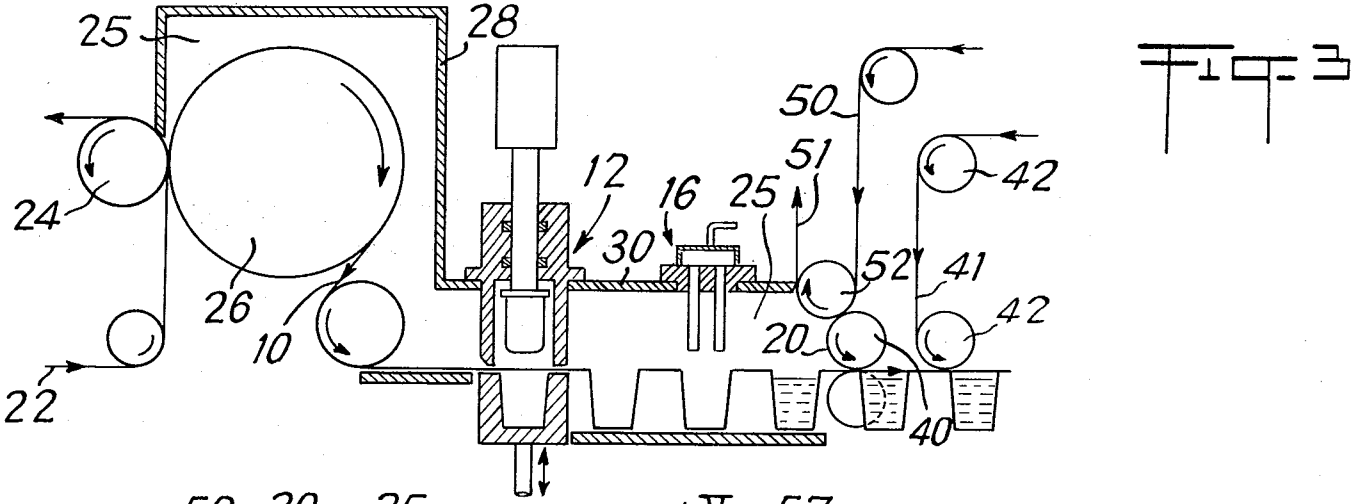
FIGS. 3 and 4 are very diagrammatic partial views in elevation and longitudinal section illustrating a second and third embodiment of the invention.

The installation shown in FIG. 3 is identical to that shown in FIGS. 1 and 2 with the exception of the supply of the covering strip 20. In fact, this strip 20 is not sterilized just before its application to the containers, but is withdrawn, like the thermoplastic film, from a composite strip 50. The latter is constituted by the strip 20, which may be a thermoplastic strip of the same type as the film 10, and by a backing strip 51 pressed one against the other in an air-tight manner at least along their edges and with their faces in contact sterile. The composite strip 50 may be manufactured like the composite strip 22. Separation of the strip 51 takes place at the point where the composite strip 50 enters the enclosure 25, only the strip 51 being returned to the outside of the enclosure, whilst being guided by a roller 52 and the strip 20 being pressed against the thermoplastic film by the pressing rollers 40. In FIG. 3 it should be noted that at its downstream end, the enclosure 25 is closed off by the sterile sides of the strips 20 and 51 which have just been separated from each other. Drive means (not shown) are provided for moving the composite strip 50 in synchronism with the thermoplastic film and for supplying the backing strip 51, after its separation from the covering strip 20, to a re-winding roller.

Figure 4:
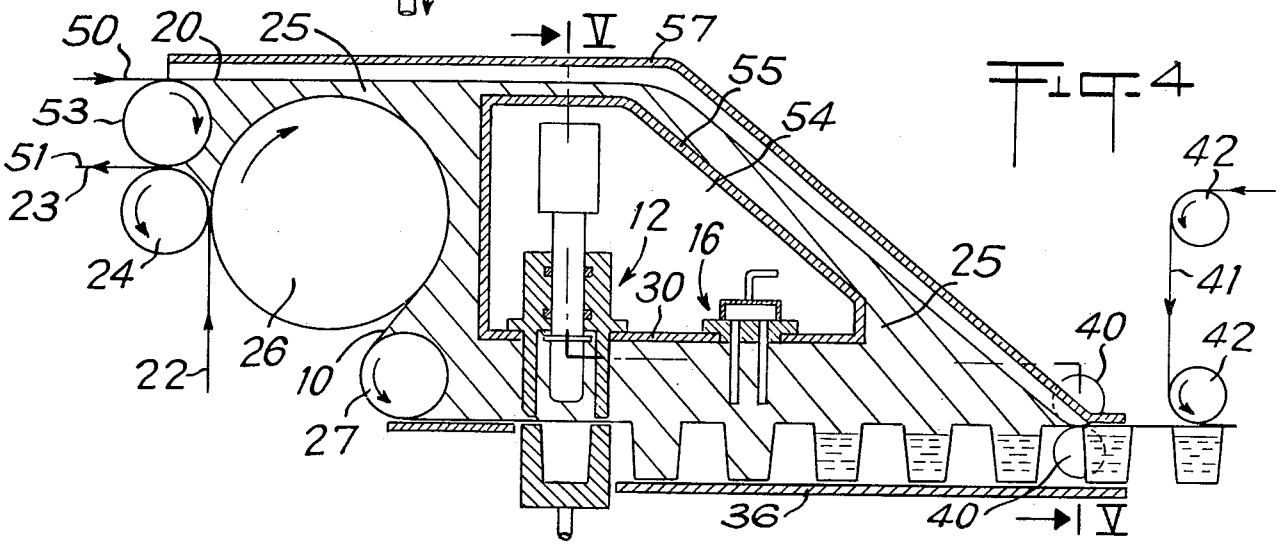
Figure 5:
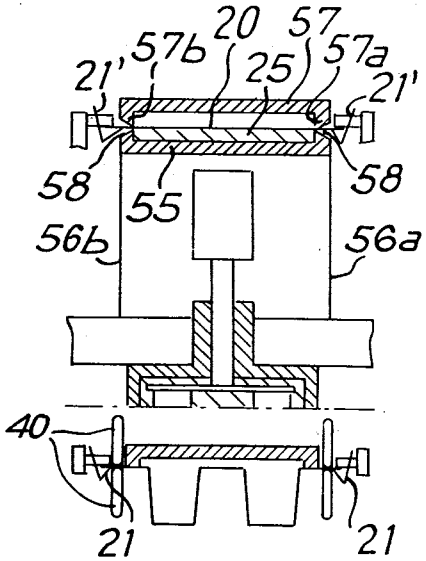
FIG. 5 is a very diagrammatic view in section on line V—V of FIG. 4.

In the installation shown in FIGS. 4 and 5, the film 10 and the covering strip 20 are withdrawn from two separate composite film 22 and strip 50, their separations from the respective covering film 23 and backing strip 51 being undertaken in the region of the upstream end of the sterile enclosure 25. Adjacent guide rollers 53, 24 rotating in opposite directions, return the film 23 and the strip 51 to the outside of the enclosure 25. The sterile sides of the film 23 and of the strip 51 may be pressed one against the other, in an air-tight manner at least along their edges before being contaminated by the non-sterile atmosphere. This pressing operation is carried out at the latest at the outlet of the sterile enclosure 25, for example by means of rollers 53, 24. One thus recovers a composite film formed by the film 23 and the strip 51, which composite film may advantageously be re-used as it stands. In particular, if one uses two composite films 22 and 50 of an identical type each constituted by a first and second film and if the first film of one and the second film of the other are used as thermoplastic film and covering strip respectively, one thus advantageously recovers a composite film which is identical to those used and re-use of which facilitates a considerable saving in material.

After its separation from the backing strip 51 until it is pressed against the thermoplastic film 10 leaving the enclosure, the covering strip 20 constitutes the upper wall of the sterile enclosure 25 (shown by broken lines in FIGS. 4 and 5) and passes above the drum 26, the roller 27, the forming station 12 and the filling station 16.

The parts of the forming and filling stations which are above the shaping chamber 14 and the nozzle support supported by the horizontal wall 30 are located inside a transverse tunnel 54 which is connected to the outside and passes through the sterile enclosure 25 whilst being insulated in an air-tight manner by a transverse partition closed on itself. This partition is constituted by the wall 30, which forms the lower wall of the tunnel 54 and a wall 55 substantially in the shape of an inverted U which passes above the forming and filling stations and is connected to the upstream and downstream ends of the wall 30.

Laterally, the sterile enclosure 25 is closed by vertical walls 56 whose upper edge follows the path of the strip 20, whereof the lower edge follows the path of the film 10 and which comprise openings **56*a* and 56*b* which constitute access points to the tunnel 54 (FIG. 5**).

The horizontal walls 35, 36 extend below the film 10 respectively upstream and downstream of the forming station 12, the wall 36 being able to move vertically. A wall or roof 57, having a section in the form of an inverted U, extends above the path of the covering strip 20. The vertical rims **57*a*, 57*b* of this wall 57 are in alignment with the side walls 56 and are flush with the upper side of the strip 20. The edges of the strip 20 are thus guided in some way in slots 58 (FIG. 5), the movement of the strip 20 being able to be produced by means of grippers 21', similar to the grippers 21, which grip the edges of the strip 20 outside the side walls of the sterile enclosure. The edges of the slots 58** may possibly be provided with sealing lips.

As a variation (this is also valid for the embodiments described previously and hereafter) guidance of the film 10 and strip 20 along their respective paths in the enclosure, after heating of the film 10, could be achieved by providing the rigid side walls of the sterile enclosure, on the inner side, with guide slides for the edges of the film and of the strip. Transportation may thus be achieved, at least for the covering strip in the example shown in FIGS. 4 and 5, by means of a conveyor belt comprising lugs engaged in the edges of this strip, as described for example in French Patent Application No. 75 38785.

The film 10 and the strip 20 are connected at the downstream end of the sterile enclosure 25, sealing of the containers then taking place, after superimposition of a possible covering band 41, as described above.

At the time of starting up, the sides of the walls 57, 55, 30, 35 and 36 which are facing the inside of the enclosure are sterilized, the wall 36 being moved into the upper position, the end sections of the film 10 and strip 20 are pulled as far as the outlet of the enclosure and the sterile atmosphere is established in the enclosure. Only then are the film 10 and strip 20 moved stepwise in synchronism, the wall 36 is lowered into the lower position and operation of the forming and filling stations is initiated.

Figure 6:
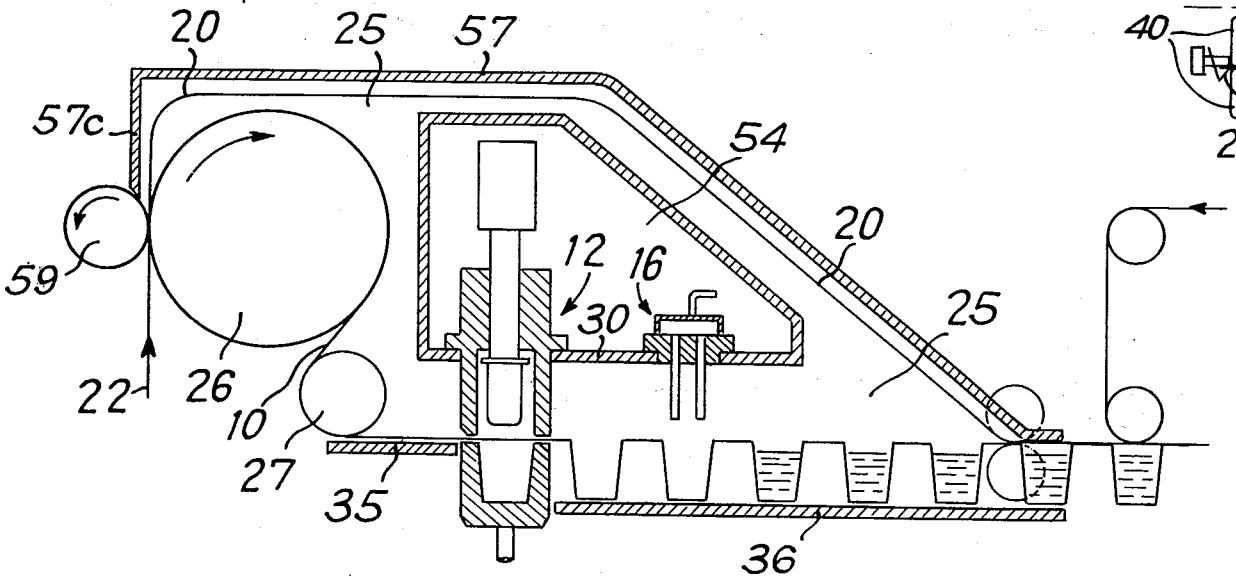
FIGS. 6, 7 and 8 are very diagrammatic partial views in elevation and longitudinal section illustrating a fourth, fifth and sixth embodiment of the invention
Figure 5:
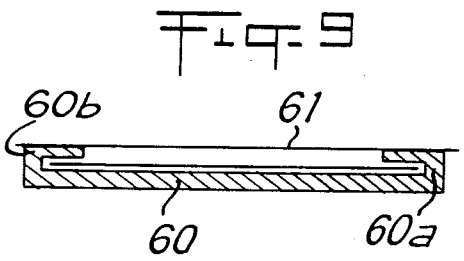

The installation shown in FIG. 6 differs from that shown in FIG. 4 by the fact that the covering strip 20 is the covering film which constitutes the composite film 22 with the thermoplastic film 10, the opposing faces of the film 10 and strip 20 being sterile. The latter is a particularly advantageous embodiment, since only one composite film 22 is necessary.

After their separation, the film 10 and strip 20 pass through the transverse tunnel 54 and constitute the lower and upper walls of the sterile enclosure 25. As above-mentioned, the strip 20 is conveyed in synchronism with the film 10, for example by being gripped by its edges outside the lateral walls of the enclosure, by means of grippers supported by endless chains.

The wall 57, which overhangs the path of the covering strip 20, is extended rearwards, by a vertical rim **57*c* which extends as far as the point where the film 22 is separated to form a thermoplastic film and a covering strip. This separation is achieved when the film 22 comes into contact with the heated drum 26, by passing between the latter and a roller 59**.

For starting up the installation, one proceeds in the same manner as described previously with reference to FIG. 4, the formation of the sterile enclosure in this case being effected by separating the end portion of the composite film 22 into an end portion of the thermoplastic film 10 and a portion of the covering strip 20, then by connecting the free ends of these sections at the outlet of the enclosure, in order to close the latter, before proceeding with forming and filling of the containers, by moving the thermoplastic film and covering strip in synchronism, whilst separating them from each other at the entrance to the enclosure, as they are moved forwards, under the effect of pulling forces exerted in diverging directions by means for conveying these film and strip.

Figure 7:
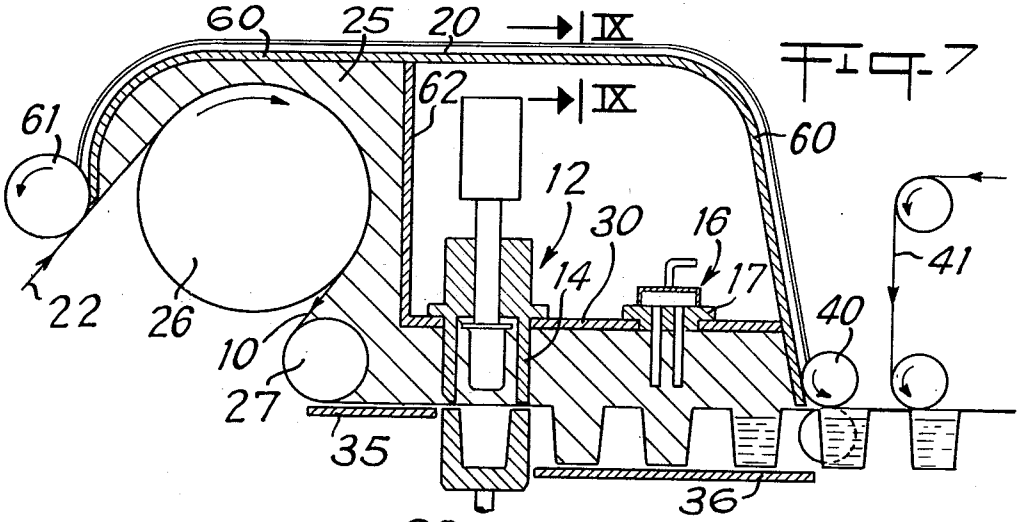

In the installation shown in FIG. 7, the convering strip 20 is constituted, as in the preceding case, by the covering film which constitutes the composite film 22 with the thermoplastic film 10. However, as in the case of the embodiments illustrated in FIGS. 1 and 3, the upper wall of the sterile enclosure is constituted by rigid wall members.

From the time of its separation from the film 10, the covering strip 20 is guided in a passage 60, in the region of the roller 61, until it is re-connected to this same film 10, at the outlet of the enclosure. The passage 60 passes above the heated drum 26, the heated return roller 27 and the forming and filling stations 12 and 16.

The bottom wall of the passage 60 partly constitutes the part of the upper wall of the sterile enclosure upstream of the forming station and is connected by a second of a vertical wall 62 to the horizontal wall 30 which supports the chamber 14 and the nozzle support 17.

In the example illustrated (see FIG. 9), the passage 60 is in the form of a slide. This slide is supplied with sterile gas at a pressure slightly greater than external pressure, from orifices (not shown) which open into its base and are connected to a source of sterile gas. The base of the slide is located opposite the sterile side of the covering strip intended to come into sealed contact with the thermoplastic film. On the upper side, the slide comprises lateral rims 60*a*, 60*b* bent inwards to surround the marginal areas of the strip 20. A protection plate 61 may cover the slide, above the strip 20, thus constituting a passage in the form of a chute or tunnel in which a sterile atmosphere prevails at slight excess pressure. It will be noted that the circulation of sterile gas in the space between the base of the slide and the sterile side of the strip on the one hand, prevents contamination of this space and on the other hand facilitates guidance of the covering strip 20 in a floating manner in the slide. It is not necessary to provide special means for transportation of the covering strip 20, the drive being produced by the simultaneous movement of the connected covering strip and thermoplastic film.

Starting up of the installation takes place substantially as described with reference to FIG. 1.

Figure 8:
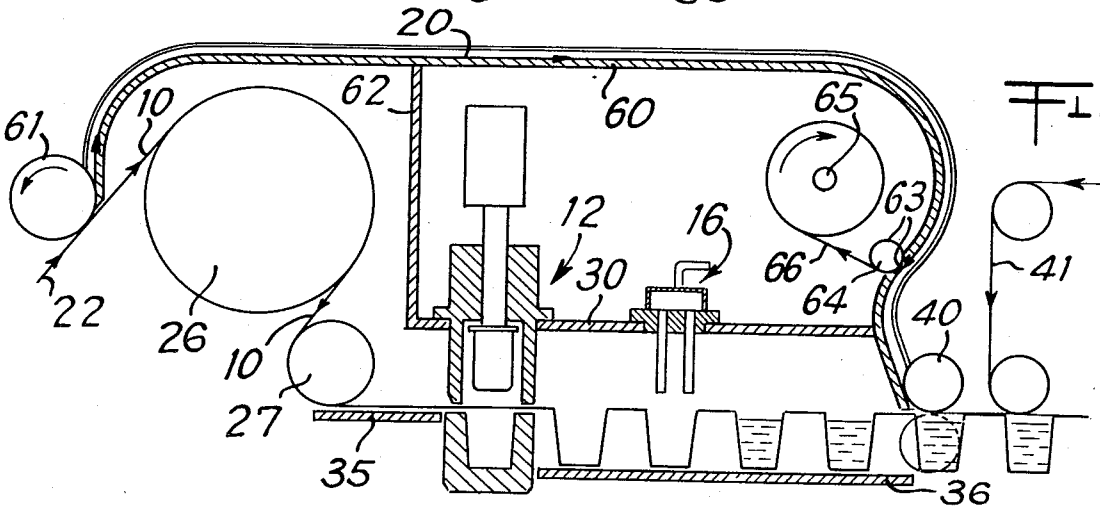

The embodiment of the invention illustrated diagrammatically in FIG. 8 differs from that illustrated in FIG. 7 by the fact that the composite film 22 comprises, apart from the thermoplastic film 10 and the covering strip 20, an intermediate film 66 interposed between the former, and connected thereto in an air-tight manner at least along its edges and having sterile sides as do the sides of the thermoplastic film and covering strip facing the intermediate strip 66.

The manufacture of the triple composite film 22 is similar to that of the double composite film. In may be produced by forming a first double film in a sterile medium, then by adding, still in a sterile medium, the sterilized thermoplastic film or covering strip, to this double film. This production may also be achieved by simultaneously or successively extruding the thermoplastic film and the covering strip on either side of the intermediate film sterilized by heat. In particular, it will be noted that a triple composite film of this type makes it possible to use only one composite film in the case where the thermoplastic film and the covering strip are made of the same material, which, for a double film, could pose problems of separation.

In fact, the thermoplastic film 10 is separated from the two other films 66 and 20 at the entrance to the passage 60, an entrance which thus also constitutes the entrance to the sterile enclosure 25.

The covering strip 20 is then separated from the intermediate film 66 by passing the latter through a slot 63 provided in the bottom of the passage 60, downstream of the connection of this passage to the wall 62, i.e. at a location where the bottom wall of the passage 60 does not constitute part of the upper wall of the enclosure. The intermediate film 66 guided on a roller 64 is rewound on a roller 65 whereas the covering strip is then guided alone through the remaining portion of the passage 60 as far as the location where it is pressed against the thermoplastic film.

By way of a variation, it is possible to separate the covering strip 20 from the two other films 66 and 10 at the entrance to the sterile enclosure, the covering strip 20 being moved along in the passage 60 towards the outlet of the enclosure. The intermediate film 66 is thus separated from the thermoplastic film 10 before the latter leaves the drum 26 and is moved out of the sterile enclosure for example through a slot provided in the wall 62.

The method and installation according to the invention, of which several embodiments have been described, makes it possible to pack various food stuffs or pharmaceutical products in a sterile medium.

Naturally, numerous variations could be applied to these examples without diverging from the scope of protection defined by the accompanying claims.

What is claimed is:

1. A method of packaging in a sterile medium, comprising the steps of:

providing a composite film comprised of a thermoplastic film covered, on a first side, by at least one covering strip;

moving said composite film towards the entrance of a sterile enclosure having sidewalls, an upper wall and a lower wall, the thermoplastic film and the covering film being superimposed in an air-tight manner at least along their edges and with their opposing sides being sterile;

separating the covering film from the thermoplastic film at the entrance to the sterile enclosure;

guiding the thermoplastic film along a path from the entrance to the sterile enclosure to a forming station, the portion of the thermoplastic film being guided along the path forming at least a portion of the lower wall of the sterile enclosure;

forming containers in the thermoplastic film at the forming station inside the sterile enclosure in which slight excess pressure prevails, said forming being performed by shaping the thermoplastic material heated to a forming temperature, the inner surface of said containers being formed by said first side of the thermoplastic film;

filling the containers at the filling station inside the sterile enclosure;

covering the full containers, without their contents being able to be contaminated by non-sterile atmosphere, with a covering strip, whereof at least the side facing the inside of the containers is sterile; and, at the outlet of the sterile enclosure, connecting the covering strip in an air-tight manner to at least the edges of the thermoplastic film presenting full containers.

2. A method as claimed in claim 1, comprising separating the covering film from the thermoplastic film at a separation temperature lower than the forming temperature, and subsequently heating the thermoplastic film to said forming temperature as it travels between the entrance to the sterile enclosure and the forming station.

3. A method as claimed in claim 1, comprising heating the thermoplastic film to the forming temperature by contact with at least one heating surface.

4. A method as claimed in claim 1, comprising heating the thermoplastic film over part of its path, upstream of the forming station, where it already comprises at least part of the wall of the sterile enclosure.

5. A method as claimed in claim 1, comprising, in order to provide the containers with a covering strip having at least one sterile side, the provision of a composite strip comprised by the covering strip, covered, on its side intended to face the inside of the containers, by a backing strip, the latter and the covering strip being superimposed in an air-tight manner at least along their edges and having sterile opposing faces, and the separation of the backing strip from the covering strip as the latter enters the sterile enclosure.

6. A method as claimed in claim 5, wherein the covering strip forms at least one part of the upper wall of the sterile enclosure until the full containers are covered.

7. A method as claimed in claim 1, comprising: using a composite film comprised of the thermoplastic film and at least the covering strip, the latter comprising the covering film of said composite film; moving said covering strip, after separation of the thermoplastic film, towards the outlet of the sterile enclosure, along a path which overhangs that of the thermoplastic film and the forming and filling stations; and, at the outlet of the sterile enclosure, covering the containers which have been formed and filled, by the lower sterile side of the covering strip, said covering strip and said thermoplastic film comprising the containers being pressed one against the other in an air-tight manner at least along their edges.

8. A method as claimed in claim 7, comprising: using a composite strip comprised at the thermoplastic film, an intermediate film, whereof one side lies against the side of the strip for containers subsequently intended to form the inner side of the containers, and the covering strip against the other side of the intermediate film, the thermoplastic film, the intermediate film and the covering strip being superimposed in an air-tight manner at least along their edges, and the sides of the intermediate film as well as the sides of the thermoplastic film and of the covering strip located opposite the intermediate film being sterile; separating the intermediate film from the thermoplastic film and the covering strip; and discharging said intermediate film to the outside, in a non-sterile atmosphere, by passing the latter through a slot in a wall on one side of which a sterile atmosphere prevails.

9. A method as claimed in claim 7, comprising passing the covering strip through a passage in the form of a slide located above an upper rigid wall of the enclosure, at least the part of the passage located below the covering strip being sterile.

10. A method as claimed in claim 9, comprising providing a sterile guide slide which covers the covering strip on either side of the marginal areas as well as adjacent the side intended to come into sealed contact with the thermoplastic film comprising the full containers.

11. A method as claimed in claim 9, comprising using at least one part of the bottom wall of said sterile passage for producing at least one part of the wall covering the sterile enclosure.

12. A method as claimed in claim 9, comprising guiding the covering strip in a floating manner through said sterile passage by circulating a sterile gas in the space comprised between the bottom of said passage and the covering strip.

13. A method as claimed in claim 5, comprising using the sterile side of the covering strip to form the upper wall of the sterile enclosure.

14. A method as claimed in claim 13, comprising passing the thermoplastic film and the covering strip respectively under and above a transverse tunnel, connected to the outside, passing through the sterile enclosure and in which the upper members of the forming and filling stations are housed.

15. A method as claimed in claim 1, comprising connecting the edges of the covering strip and the edges of the thermoplastic film by means of grippers.

16. A method as claimed in claim 1, comprising connecting the edges of the covering strip and the edges of the thermoplastic film by means of pairs of pressing rollers.

17. A method as claimed in claim 1, comprising sealing the covering strip on each container around its filling opening only after having connected said strip to the edges of the thermoplastic film.

18. A method as claimed in claim 1, comprising conveying the thermoplastic film, in the area of the sterile enclosure, in the region where containers have been formed, by connecting its edges to conveying members outside the side walls of this enclosure.

19. A method as claimed in claim 1, comprising using a movable strip as covering strip, the covering strip and the thermoplastic film being guided, at least in the area of the enclosure, by means of a guide slide supported by the side walls of the enclosure and by means of conveyor belts connected to the longitudinal edges of the film and strip and passing in the guide slides.

20. A method as claimed in claim 1, further comprising applying a covering band to the covering strip adjacent the outlet area of the sterile enclosure and sealing said covering band and strip on each container.

21. A method as claimed in claim 1, wherein, at the time for starting up, the enclosure is closed by means of a section of the thermoplastic film and, if selectively, of a section of the covering strip, in order to form the sterile enclosure and a sterile atmosphere is established in this enclosure, before moving the thermoplastic film stepwise, and the thermoplastic film and the covering strip are advanced in synchronism.

22. A method as claimed in claim 7, comprising, at the time of starting up, separating the end section of the composition film into a section of the thermoplastic film and a section of the covering strip; closing the enclosure by means of the section of the thermoplastic film and, selectively, of the section of the covering strip, the free ends of said sections being connected in an air-tight manner on leaving said enclosure in order to form the sterile enclosure; and starting the forming of the containers in the thermoplastic film, the filling of the containers formed, and the stepwise advance of said thermoplastic film and covering strip in synchronism, whilst separating the composite film, at the entrance to the enclosure, into the thermoplastic film and the covering strip, as they are moved forwards.

23. A method as claimed in claim 5, wherein, after separation of the thermoplastic film and covering strip, from their respective composite film and strip, the sterile side of the covering film is pressed against that of the backing strip, in an air-tight manner at least along their edges, before these sides can be contaminated by the non-sterile atmosphere and the composite strip formed in this way is recovered.

24. A method according to claim 23, comprising providing a composite film to form the first and second sides of said container, both said sides being comprised of a first and second film, the first film of one side and the second film of the other side being used as thermoplastic film and covering strip and a composite film identical to that used being recovered.

25. Installation for packaging in a sterile medium, comprising:

a sterile enclosure having lateral walls, and upper and lower walls;

means for supplying the enclosure with sterile gas at a pressure slightly greater than the pressure prevailing outside the enclosure;

means for separating a thermoplastic film, by traction, at the entrance to the sterile enclosure, from a covering film applied to the thermoplastic film in an air-tight manner at least along its edges;

first means for conveying said thermoplastic film so that this film forms at least one part of the lower wall of the sterile enclosure;

a station for heating the thermoplastic film to a forming temperature;

a station for forming containers in said thermoplastic film located at least partly in the sterile enclosure and comprising at least one mould able to move vertically under the thermoplastic film and at least one forming punch able to move vertically inside a chamber located above the thermoplastic film;

a filling station comprising at least one nozzle supported by a nozzle support and opening out above the plane of the thermoplastic film;

a covering station for covering the full containers with a covering strip;

and a sealing station for sealing the covering strip on each container, in an air-tight manner, around its filling opening, said chamber and said nozzle support being mounted in a sealed manner on part of the wall of the enclosure which overhangs the plane of the thermoplastic film, the parts of the forming station located above said chamber, the parts of the filling station located above the nozzle support and all the part of the covering and sealing stations being outside the sterile enclosure.

26. Installation as claimed in claim 25, wherein the heating means are located along at least one part of the path of the thermoplastic film between the entrance to the sterile enclosure and the forming station.

27. Installation as claimed in claim 25, comprising guide means for guiding the covering strip along a path separate from that of the thermoplastic film between a first location upstream of the forming station and a second location forming the downstream end of the sterile enclosure and passing above the forming, shaping and filling stations.

28. Installation as claimed in claim 27, wherein the guide means comprise a passage in the form of a slide which overhangs the plane of the thermoplastic film and in which the covering strip is guided, means being provided for producing a sterile atmosphere inside said passage.

29. Installation as claimed in claim 27, comprising means for separating, at the entrance to the sterile enclosure, the thermoplastic film and the covering strip previously superimposed one on the other in an air-tight manner at least along their edges and in that the covering strip, on its path between said first and second locations, comprises part of the upper wall of the sterile enclosure, has a width greater than the distance separating the opposing sides of the lateral walls of the enclosure in the region of said path of the covering strip and the edges of the latter project beyond said lateral walls.

30. Installation as claimed in claim 29, further comprising second conveying means for moving the covering strip between said first and said second locations by gripping the edges of this strip outside the lateral walls of the enclosure.

31. Installation as claimed in claim 25, comprising a transverse tunnel which is connected to the outside of said sterile enclosure, which is separated in an air-tight manner from the inside of the sterile enclosure and in which the parts of the forming and filling stations not located in the sterile enclosure are housed.

32. Installation as claimed in claim 31, in which the lower wall of the tunnel is said part of the wall of the enclosure on which said chamber and nozzle support are mounted.

33. An installation for packing a product in a sterile medium comprising:

a sterile enclosure having side walls, an upper wall and a bottom wall;

means for supplying said sterile enclosure with sterile gas at a pressure slightly greater than the pressure prevailing outside said sterile enclosure;

means for carrying a container strip of thermoplastic material, said container strip forming at least part of the bottom wall of said sterile enclosure;

a station for heating said container strip;

a station for forming containers in said container strip situated at least in part in said sterile enclosure and comprising at least one mold vertically mobile under said container strip, and at least one forming punch mobile vertically inside a sleeve above the transport level of said container strip beyond the entrance to said forming station;

a filling station comprising at least one nozzle carried by a nozzle support and opening out above said transport level of said container strip;

a covering station for covering filled containers with a cover strip, without the inside of said containers being contaminated by a non-sterile atmosphere;

a sealing station for sealing in a tight manner said cover strip on said container strip around the filling opening of each container;

means disposed at an entrance to said sterile enclosure for separating said container strip from said cover strip by traction, said container strip and said cover strip being previously superimposed against one another in an air-tight manner at least along their sides and having sterile sides facing one another; and guiding means for guiding said cover strip between said entrance to said sterile enclosure and said covering station at a delivery end of said sterile enclosure, said cover strip passing above said forming and said filling stations, said sleeve of said forming station and said nozzle support of said filling station both being mounted on a portion of a wall of said external enclosure which overhangs said transport level of said container strip, the elements of said forming and said filling station being situated above said sleeve and above said nozzle support, and the elements of said covering and said sealing stations being situated outside said sterile enclosure.

34. An installation as claimed in claim 33 wherein said heating station is situated on the path of said container strip between the entrance to said sterile enclosure and the entrance of said forming station.

35. An installation as claimed in claim 33 further comprising a passage in the form of a slide which extends substantially from the entrance of said sterile enclosure to the exit of said sterile enclosure, said passage passing above said forming and said filling stations and being supplied with sterile gas at a pressure slightly above ambient pressure.

36. An installation as claimed in claim 35 wherein at least part of the bottom wall of said passage constitutes at least a part of said upper wall of said sterile enclosure.

37. An installation as claimed in claim 33 further comprising second transport means to guide said cover strip between the entrance of said sterile enclosure and the exit of said sterile enclosure, said cover strip forming at least one part of said top wall of said sterile enclosure.

38. An installation as claimed in claim 37 wherein said second transport means comprise mobile gripping means disposed outside said sterile enclosure for gripping the edges of said cover strip protruding laterally on each side of said sterile enclosure.

39. An installation as claimed in claim 33 wherein said container strip and said cover strip form at least portions of said bottom wall and said top wall of said sterile enclosure, said installation further comprising a transverse tunnel which is surrounded by said sterile enclosure and which passes through said sterile enclosure from one side to another side, said transverse tunnel communicating with an outside atmosphere and containing upper elements of said forming station and said filling station, said portion of said wall of said enclosure to which said sleeve and said nozzle support are connected constituting a part of the bottom wall of said tunnel.

40. An installation as claimed in claim 33 further comprising a wall portion situated along the path of said container strip under said transport level of said container strip downstream of said forming station, said wall portion being vertically movable between a high position wherein said wall portion is located in the immediate vicinity of said transport level of said container strip, and a low position wherein containers formed in said container strip are permitted to travel towards said delivery end of said sterile enclosure.

41. An installation as claimed in claim 33 wherein said covering station comprises pressing rollers external of sterile enclosure for applying in an air-tight manner the edges of said cover strip onto the edges of said container strip.

42. An installation as claimed in claim 33 wherein said sidewalls of said sterile enclosure have bottom edges conforming to the path of said container strip from said entrance of said sterile enclosure to said delivery end of said sterile enclosure and which are separated from each other by a distance less than the width of said container strip so that the edges of said container strip protrude laterally from each side of said sterile enclosure.

43. An installation as claimed in claim 33 wherein said heating station comprises at least one heating drum over which said container strip passes.

44. An installation as claimed in claim 43 wherein said heating drum is located above the horizontal plane which contains said transport level of said container strip.

45. An installation as claimed in claim 33 further comprising means for applying a covering band onto said cover strip between said covering station and said sealing station.

* * * * *